US007412853B2

(12) United States Patent
Hong et al.

(10) Patent No.: US 7,412,853 B2
(45) Date of Patent: Aug. 19, 2008

(54) WASHING MACHINE COMBINED WITH DRYER

(75) Inventors: Sog Kie Hong, Seoul (KR); Kyung Seop Hong, Incheon-si (KR)

(73) Assignee: LG Electronics Inc., Seoul (KR)

( * ) Notice: Subject to any disclaimer, the term of this patent is extended or adjusted under 35 U.S.C. 154(b) by 386 days.

(21) Appl. No.: 11/184,420

(22) Filed: Jul. 18, 2005

(65) Prior Publication Data

US 2006/0123854 A1 Jun. 15, 2006

(30) Foreign Application Priority Data

Dec. 10, 2004 (KR) ..... 10-2004-0104076

(51) Int. Cl.
*D06F 25/00* (2006.01)

(52) U.S. Cl. ..... 68/19.1; 68/20

(58) Field of Classification Search ..... 68/19.1, 68/20

See application file for complete search history.

(56) References Cited

U.S. PATENT DOCUMENTS

| | | | | | |
|---|---|---|---|---|---|
| 2,825,148 | A | * | 3/1958 | Olson | 34/75 |
| 2,893,135 | A | * | 7/1959 | Smith | 34/610 |
| 2,959,044 | A | * | 11/1960 | Stone | 68/12.15 |
| 3,220,230 | A | * | 11/1965 | Jacobs et al. | 68/19.2 |
| 3,292,347 | A | * | 12/1966 | Hodgkinson | 261/83 |
| 3,639,998 | A | * | 2/1972 | Mason | 34/82 |
| 4,204,339 | A | | 5/1980 | Muller | |
| 4,653,200 | A | | 3/1987 | Werner et al. | |
| 4,700,492 | A | * | 10/1987 | Werner et al. | 34/403 |
| 5,143,528 | A | * | 9/1992 | Dongelmans | 55/283 |
| 5,272,781 | A | * | 12/1993 | Bastin et al. | 8/158 |
| 5,628,122 | A | * | 5/1997 | Spinardi | 34/79 |
| 5,741,340 | A | * | 4/1998 | Klemmer | 96/356 |
| 7,055,262 | B2 | * | 6/2006 | Goldberg et al. | 34/86 |
| 7,168,274 | B2 | * | 1/2007 | Slutsky et al. | 68/19 |

FOREIGN PATENT DOCUMENTS

| | | | |
|---|---|---|---|
| EP | 0501747 | | 9/1992 |
| EP | 0816549 | | 1/1998 |
| EP | 1353004 | | 10/2003 |
| GB | 2 044 297 | * | 10/1980 |
| GB | 2 219 652 | * | 12/1989 |
| GB | 2219652 | | 12/1989 |
| GB | 2287476 | | 9/1995 |
| JP | 2002-200395 | * | 7/2002 |
| JP | 2004261324 | | 9/2004 |

* cited by examiner

*Primary Examiner*—Frankie L Stinson
(74) *Attorney, Agent, or Firm*—Lee, Hong, Degerman, Kang & Schmadeka

(57) ABSTRACT

There is provided a washing machine combined with a dryer. In the washing machine, a cabinet is provided, a tub is installed in the cabinet, an air-vent hose is installed to an outer surface of the tub, a lint filter assembly has one end connected to the air-vent hose to remove lint from air discharged from the tub, and an air-vent duct is connected to the other end of the lint filter assembly.

15 Claims, 5 Drawing Sheets

WASHING MACHINE COMBINED WITH DRYER

CROSS-REFERENCE TO RELATED APPLICATIONS

Pursuant to 35 U.S.C. § 119(a), this application claims the benefit of earlier filing date and right of priority to Korean Application No. 10-2004-0104076, filed on Dec. 10, 2004, the contents of which are hereby incorporated by reference herein in their entirety.

BACKGROUND OF THE INVENTION

1. Field of the Invention

The present invention relates to a washing machine, and more particularly, to a drum type washing machine combined with a dryer, in which a lint filter assembly is provided to collect and remove foreign substances such as lint generated during a heat drying operation.

2. Description of the Related Art

A washing machine is a home appliance for washing clothes automatically. A typical washing machine uses an electric motor as a driving unit to agitate clothes together with water containing detergent to remove dirt from the clothes. The washing process of the washing machine generally includes washing, rinsing, spin-drying, and/or heat-drying operations.

Washing machines can be classified into a drum type washing machine, an agitator type washing machine, and a pulsator type washing machine.

The drum type washing machine includes a plurality of lifters inside of a drum to lift up and drop down clothes in the drum as the drum is rotated about a horizontal axis at a low speed. Therefore, the clothes can be cleaned by the collision with water containing detergent.

Meanwhile, a washing machine combined with a dryer is recently introduced to satisfy user's demand. In this washing machine, clothes are heat dried after washed, rinsed, and spin dried.

The washing machine combined with the dryer can be classified into a condenser type and a vented type depending on a drying method.

The washing machine combined with the condenser type dryer removes residual moisture from clothes by circulating air through a drum, a heat exchanger, and a heater without discharging the air out of the washing machine until the heat drying operation is completed. That is, the air becomes moist after passing through the drum, the moist air cools down at the heat exchanger by exchanging heat with a cooling water, the moisture in the air condenses and drops down to the bottom of the tub as the moist air cools down, and the air is heated again by the heater and then enters the drum again.

In the washing machine combined with the vented type dryer, on the contrary, a heated dry air is blew into a drum to take moisture from clothes and then the air containing lots of moisture is discharged out of the washing machine through a connecting pipe connected between a tub and a vent duct.

However, the moist air, which is discharged from the washing machine combined with the vented type dryer, contains lint such as fluff, thereby contaminating the indoor air.

Further, the lint in the moist air, though it is light, falls down and builds up while it is discharged from the tub to the outside through the vent duct. Particularly, the lint builds up on a pleated surface of the connecting pipe connected between the tub and the vent duct. The build-up of the lint becomes bigger according to the time of use, blocking the vent duct. Further, the build-up of the lint increases the possibility of fire. Therefore, there is an increasing need for a structure that can remove the problems related to the lint.

SUMMARY OF THE INVENTION

Accordingly, the present invention is directed to a washing machine combined with a dryer that substantially obviates one or more problems due to limitations and disadvantages of the related art.

An object of the present invention is to provide a washing machine combined with a vented type dryer, in which an air-vent line, including an air-vent hose connected between a tub and the air-vent duct, is prevented from being plugged by lint generated during a heat drying operation.

Another object of the present invention is to provide a washing machine combined with a dryer, in which lint generated during a heat drying operation is prevented from building up in an air-vent line and therefore the possibility of fire reduces.

A further another object of the present invention is to provide a washing machine combined with a dryer that has a lint filter assembly to remove lint, the lint filter assembly being designed such that a user can easily install and replace it.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a washing machine combined with a dryer, including: a cabinet; a tub installed in the cabinet; an air-vent hose installed to an outer surface of the tub; a lint filter assembly having one end connected to the air-vent hose to remove lint from air discharged from the tub; and an air-vent duct connected to the other end of the lint filter assembly.

In another aspect of the present invention, there is provided a washing machine combined with a dryer, including: a tub provided with an air-vent hose at an outer surface; a water inlet hose to supply water to the tub; a filter housing including an air inlet connected to the air-vent hose, an air outlet to discharge air introduced from the air inlet, and a nozzle to inject water into the filter housing; a filter cover to cover a top of the filter housing; and a filter unit inserted into the filter housing through the filter cover.

In a further another aspect of the present invention, there is provided a washing machine combined with a dryer, including: a tub; a water inlet hose to supply water to the tub; and a lint filter assembly including a filter housing having a chamber for passing a moist air discharged from the tub therethrough, a filter cover to cover a top of the filter housing, and a filter unit inserted into the filter housing through the filter cover.

According to the present invention, the lint generated during the heat drying operation is separated and collected from the moist air before the moist air is discharged to the outside, thereby preventing the indoor air from contamination.

Further, the water from the water inlet hose is injected toward filter at a high pressure to remove the lint from the filter and direct the removed lint to the bottom of the tub, thereby reducing manual filter cleaning.

Further, the filter unit is removably installed such that a use can easily clean the filter, thereby preventing the lint from blocking the filter and the air vent passage.

Further, the filter is removably installed to allow manual cleaning in addition to the automatic cleaning by the water injection, thereby reducing the possibility of fire due to the combination of hot air from the tub and the build-up of lint on the filter.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
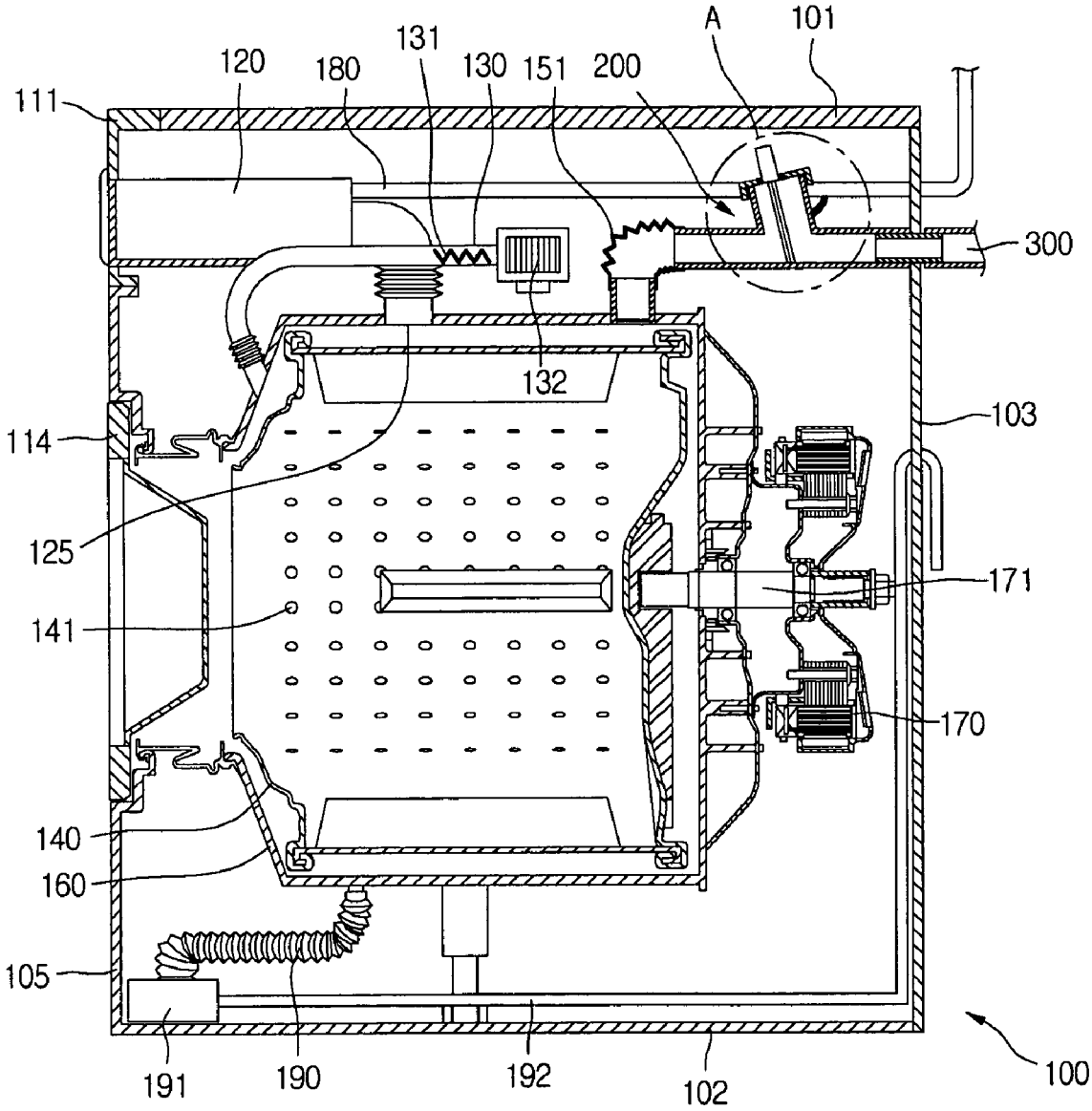
FIG. 1 is a sectional view of a washing machine combined with a dryer, in which a lint filter assembly is provided according to the present invention.

FIG. 1 is a sectional view of a washing machine combined with a dryer, in which a lint filter assembly is provided according to the present invention.

Referring to FIG. 1, a washing machine combined with a dryer 100 includes: an enclosing cabinet 103; a top plate 101 mounted on a top of the cabinet 103; a base plate 102 installed on a bottom of the cabinet 103; a front cover 105 mounted on a front of the cabinet 103; a door 114 rotatably installed at a center of the front cover 105; a control panel 111 installed at an upper portion of the front cover 105, the control panel 111 having a plurality of input buttons and a display; a detergent dispenser drawer 120 inserted into a side of the control panel 111 to receive detergent or fabric softener.

Further, the washing machine combined with the dryer 100 includes a tub 160 installed in the cabinet 103 to receive water (or mixture of water and detergent), a drum 140 installed in the tub 160 to receive clothes, and a driving motor 170 mounted on a back of the tub 160 to rotate the drum 140. The driving motor 170 includes a shaft 171 connected to a rear of the drum 140. The drum 140 defines a plurality of holes 141 to receive water from the tub 160.

Further, the washing machine combined with the dryer 100 includes a dryer duct 130 installed between the cabinet 103 and a top of the tub 160 to introduce a surrounding air into the tub 160, an air-vent hose 151 connected to a top rear of the tub 160 to vent a moist air from the drum 140 to the outside, and a lint filter assembly 200 removably installed in the air-vent hose 151 to remove lint from the moist air passing therethrough during a heat drying operation. Herein, the term "lint" is used to refer to little pieces of thread and fluff, dust, and other particles that are contained in the air passing through the lint filter assembly 200.

The lint filter assembly 200 has one end connected to the tub 160 and the other end connected to an air-vent duct 300. The dryer duct 130 includes a blower fan 132 installed therein to draw air and a heater 131 to apply heat to the drawn air.

Further, the washing machine combined with the dryer 100 includes a water drain tube 190 of which one end is connected to a bottom of the tub 160 to discharge water contaminated during a washing operation or a rinsing operation, a water drain pump 191 connected to the other end of the water drain tube 190 to pump out the contaminated water, and a water drain hose 192 to discharge the contaminated water pumped by the water drain pump 191 to the outside.

Further, the washing machine combined with the dryer 100 includes a water inlet hose 180 and a bellows 125. The water inlet hose 180 is connected to the detergent dispenser drawer 120 to supply water to the detergent dispenser drawer 120, and the bellows 125 connected between the detergent dispenser drawer 120 and a top of the tub 160 to supply the water mixed with the detergent to the tub 160.

An operation of the washing machine combined with the dryer 100 will now be described.

First, a user opens the door 114, loads clothes in the drum 140 through the opened door 114, and closes the door 114. Next, the user pulls out the detergent dispenser drawer 120 to fill it with detergent and fabric softener. Then, the user selects operating conditions using the control panel 111 and presses a start button on the control panel 111.

Upon the pressing of the start button of the control panel 111, water is supplied to the detergent dispenser drawer 120 through the water inlet hose 180. The water mixed with the detergent (washing water) enters the tub 160 through the bellows 125 connected between the detergent dispenser drawer 120 and the tub 160. The water is supplied until the tub 160 is filled with the water to a predetermined level. After the water is filled, the driving motor 170 drives the drum 140 to carry out a washing operation.

During the washing operation, the clothes and the washing water is lifted up by the rotation of the drum 140 and then dropped down. By these up and down motions and the detergent, the dirt can be removed from the clothes during the washing operation.

After the washing operation is carried out for a set time, the washing water contaminated is discharged and fresh water is supplied to the tub 160 to carry out a rinsing operation. In detail, when the contaminated water is discharged, the driving motor 170 is stopped and the water drain pump 191 is operated to drain the contaminated water from the tub 160 through the water drain tube 190. The contaminated water is dumped by the water drain pump 191 toward the water drain hose 192. Then, the fresh water (rinsing water) is supplied to the tub 160 for the rinsing operation.

Further, a spin drying operation is carried out after the rinsing operation to remove residual water from the clothes, and then a heat drying operation is optionally carried out.

In the heat drying operation, the blower fan 132 installed in the dryer duct 130 is driven to draw in a surrounding air from between the cabinet 103 and the tub 160. The heater 131 applies heat to the drawn-in air, and the heated air is directed into the tub 160 along the dryer duct 130. The heated air flows from the tub 160 into the drum 140 through the plurality of holes 141 defined in the drum 140. The heated air, having a low humidity, takes moisture from the clothes and therefore it becomes a moist air. Then, the moist air is discharged to the outside of the washing machine 100 through air-vent hose 151, the lint filter assembly 200, and the air-vent duct 300.

Here, the lint filter assembly 200 collects lint from the moist air passing therethrough. The collected lint builds up on a filter (refer to 211 in FIG. 3) of the lint filter assembly 200, and the build-up of the lint is removed from the filter 211 by injecting water from the water inlet line 180 to the filter 211. The removed lint is directed into the tub 160 through the air-vent hose 151.

The structure of the lint filter assembly 200 and method of removing the lint with the lint filter assembly 200 will now be described in detail with reference to the accompanying drawings.

Figure 2:
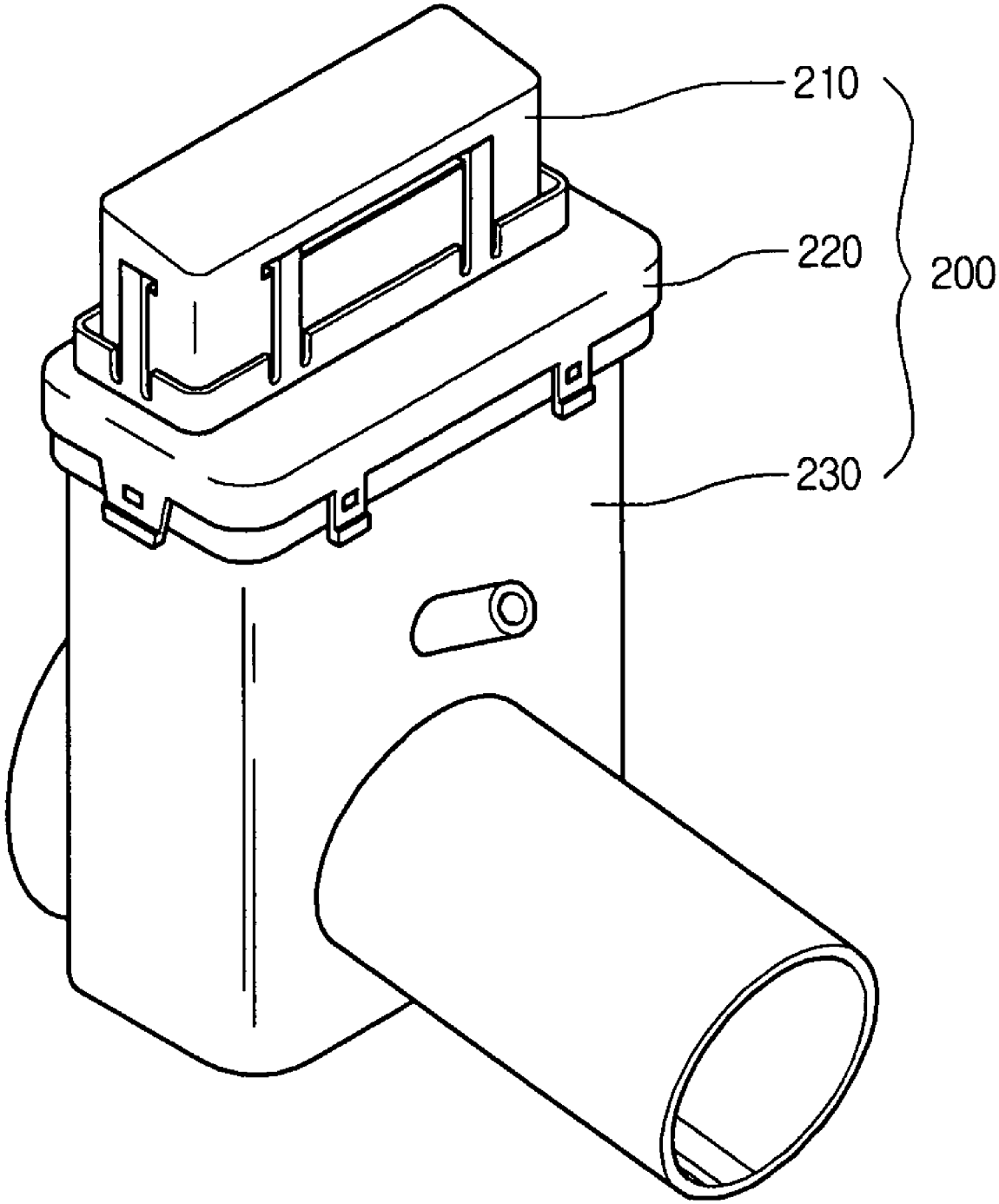
FIG. 2 is a perspective view of a lint filter assembly according to the present invention.
Figure 3:
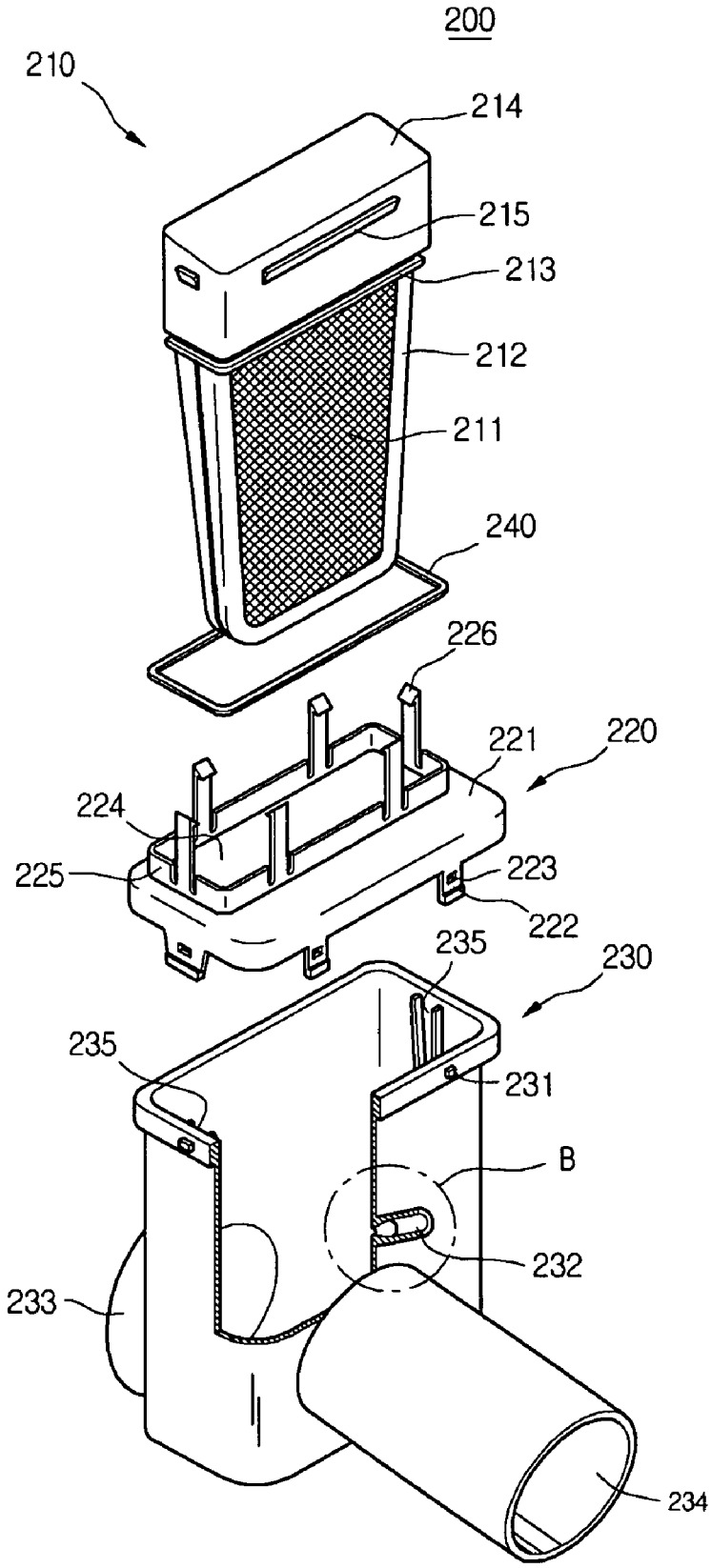
FIG. 3 is an exploded perspective view of the lint filter assembly depicted in FIG. 2.

FIG. 2 is a perspective view of a lint filter assembly according to the present invention, and FIG. 3 is an exploded perspective view of the lint filter assembly depicted in FIG. 2.

Referring to FIGS. 2 and 3, the lint filter assembly 200 includes a filter unit 210 to collect lint, a filter housing 230 in which the filter unit 210 is inserted, and a filter cover 230 coupled to a top of the filter housing 230 to prevent air leakage between the filter unit 210 and the filter housing 230.

The lint filter assembly 200 is installed in the cabinet 103 above the tub 160 as shown in FIG. 1. The lint filter assembly 200 installed in the cabinet 103 is tilted toward the front of the washing machine 100 at a predetermined angle, such that a use can easily detach the filter unit 210 and repair the lint filter assembly 200 from the front of the washing machine 100. The lint filter assembly 200 includes one end connected to the air-vent hose 151 and the other end connected to the air-vent duct 300, such that a moist air from the tub 160 during a heat drying operation can be discharged to the outside after passing through the lint filter assembly 200.

The filter unit 210 includes the filter 211, a filter frame 212 to hold the filter 211, and a handgrip 214 on the filter frame 212 for a use to hold it. The filter 211 is made of material having a number of fine holes that are densely formed, such as a mesh. The handgrip 214 defines a seal groove 213 having a predetermine depth at its lower periphery to receive a seal 240. Also, a securing structure is formed at the filter unit 210 and/or the filter cover 220 to secure the filter unit 210 to the filter cover 220. For example, the handgrip 214 includes protruded coupling ribs 215 around its vertical surfaces for coupling with coupling hooks 226 of the filter cover 220. Here, the number or shape of the coupling ribs 215 is not limited to the illustrated construction. For example, the number of the coupling ribs 215 may be coincident with the number of the coupling hooks 226.

The filter housing 230 defines an upwardly opened chamber therein to receive the filter unit 210. The filter cover 220 is coupled on the upwardly opened chamber to provide tight sealing between the filter housing 230 and the filter unit 210.

Further, the filter housing 230 includes an air inlet 233 at one side for connection with the air-vent hose 151, an air outlet 234 extendedly from the other side for connection with the air-vent duct 300, a nozzle 232 spaced apart from the air outlet 234, and at least one hooking protrusion 231 formed around an upper periphery for securing the filter cover 220. The nozzle 232 is connected to the water inlet hose 180 through a connecting tube (refer to 250 in FIG. 4) branched off from the water inlet hose 180, such that water can be injected at a high pressure into the filter housing 230 through the nozzle 232 during a heat drying operation. The injected water strikes the filter 211 to remove build-up of lint from the filter 211. The nozzle 232 will be more fully described later.

Further, the filter housing 230 includes guide ribs 235 at each inner side face to guide the insertion of the filter unit 210. The guide ribs 235 are formed in a vertical direction and spaced apart from each other according to the width of the filter frame 212 to exactly receive the filter unit 210. Also, the filter housing 230 includes a supporting protrusion (refer to 236 in FIG. 4) at an inner bottom to support a lower end of the filter frame 212 without shaking.

The shape of the filter cover 220 is corresponding to the top of the filter housing 230.

The filter cover 220 includes a cover body 221, a filter inserting slot 224 defined in the cover body 221 for the insertion of the filter unit 210, a filter supporting rib 225 extended upwardly along the periphery of the filter inserting slot 224, one or more coupling hooks 226 extended upwardly from the filter supporting rib 225, and coupling tabs 222 extended downwardly from the bottom of the cover body 221.

The filter supporting rib 225 supports the periphery of the handgrip 214 of the filter unit 210, such that the handgrip 214 can be fixed without shaking. The coupling hooks 226 are hooked on the coupling ribs 215 formed on vertical surfaces of the handgrip 214. That is, the filter unit 210 and the filter cover 220 can be securely coupled by the coupling hooks 226.

Each of the coupling tabs 222, extended downwardly from the bottom of the cover body 221, defines a coupling hole 223 for coupling with the hooking protrusion 231 formed around the upper periphery of the filter housing 230, such that the filter cover 220 can securely couple with the filter housing 230. To secure the filter cover 220 to the filter housing 230, the filter cover 220 is formed with the coupling tabs 222 each defining the coupling hole 223 and the filter housing 230 is formed with the hooking protrusion 231. However, another securing structure can be formed at the filter cover 220 and/or the filter housing 230 to secure the filter cover 220 to the filter housing 230.

The seal 240, which is inserted in the seal groove 213 of the handgrip 210, makes tight contact with the inner surface of the filter inserting slot 224 of the filter housing 220 to prevent air leakage from the filter housing 230.

In operation, a moist air generated in the tub 160 during a heat drying operation is introduced into the filter housing 230 through the air inlet 233 and passes through the filter 211. As the moist air passes through the filter 211, lint is removed from the moist air by the filter 211. After passing through the filter 211, the moist air further flows toward the air-vent duct 300 through the air outlet 234 and then discharged to the outside of the washing machine 100. Meanwhile, through the nozzle 232, water is injected into the filter housing 230. The injected water strikes the filter 211 from the back to remove build-up of lint from the filter 211, and the removed lint drops down on the inner bottom of the filter housing 230. The dropped lint is moved toward the tub 160 through the air inlet 233 and the air-vent hose 151 by the injected water. Also, the injected water as it flows through the air-vent hose 151 wipes out lint deposited on a pleated inner surface of the air-vent hose 151, thereby cleaning the air-vent hose 151.

Figure 4:
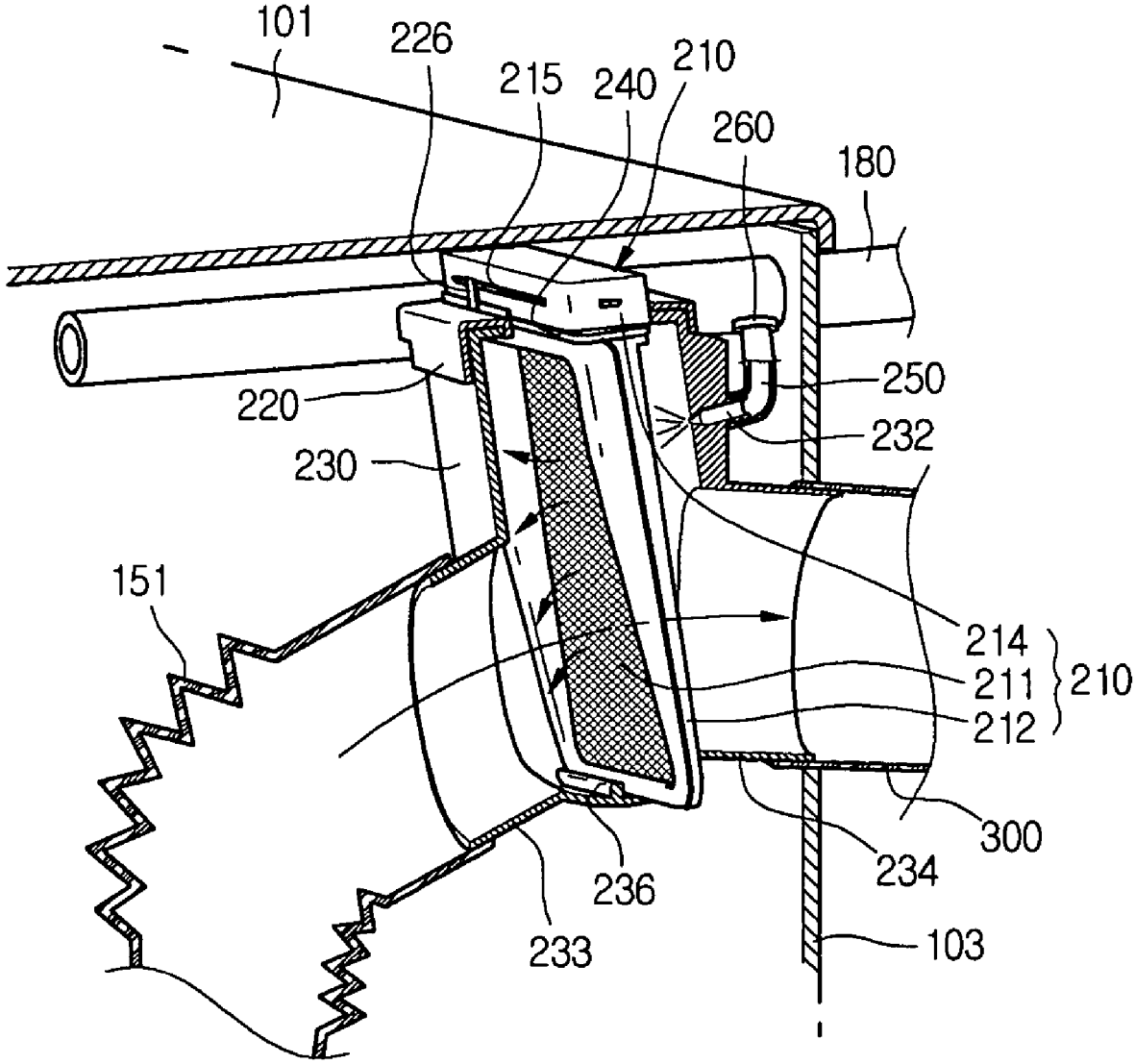
FIG. 4 is an enlarged cut-away view of the portion encircled by line "A" in FIG. 1.

FIG. 4 is an enlarged cut-away view of the portion encircled by line "A" in FIG. 1.

Referring to FIG. 4, the lint filter assembly 200 is installed between the air-vent hose 151 and the air-vent duct 300, and the connecting tube 250 branched off from the water inlet hose 180 is connected to the nozzle 232.

An on/off valve 260 may be installed between the water inlet hose 180 and the connecting tube 250, in order to close the connecting tube 250 when water is supplied to the tub 160 and close the water inlet hose 180 when a heat drying operation is carried out. That is, during the heat drying operation, the water inlet hose 180 is closed by the on/off valve 260, such that water is not supplied to the tub 160 through the detergent dispenser drawer 120.

Further, a pressure booster may be installed in the connecting tube 250 to increase the pressure of the water to inject water more strongly through the nozzle 232. Also, instead of forming the nozzle 232 on the filter housing 230, an end of the connecting tube 250 can be directly connected to the filter housing 230.

Further, since the moist air passing through the lint filter assembly 200 is hot, the lint filter assembly 200 may be preferably made of heat resistant material.

Further, since the filter unit 210 is designed to be easily detached and inserted from and into the filter cover 220, a user can manually clean the filter 211 after opening the top plate 101 and pulling the filter unit 210 out.

Figure 5:
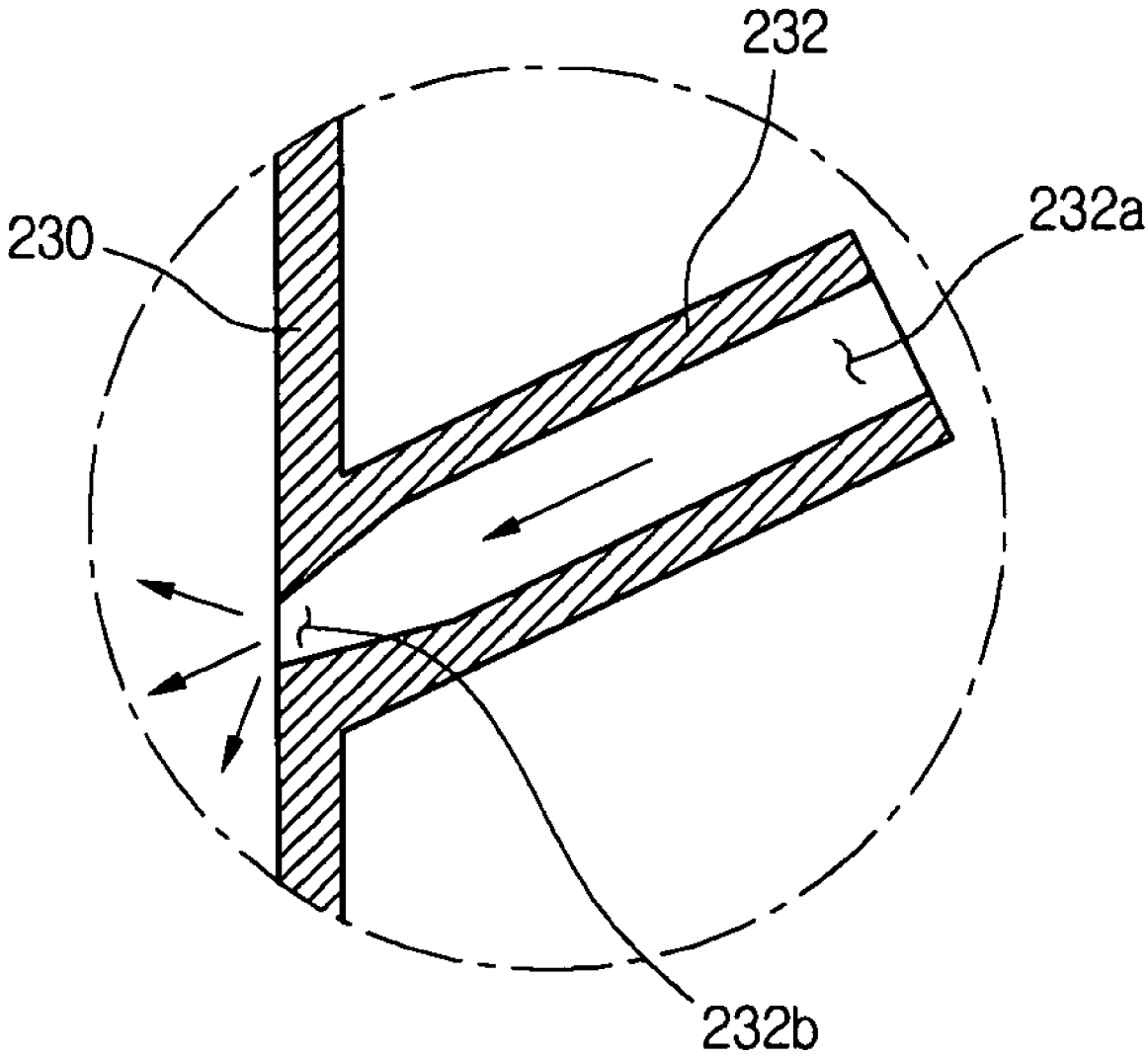
FIG. 5 is an enlarged view sectional view of the portion encircled by line "B" in FIG. 3.

FIG. 5 is an enlarged view sectional view of the portion encircled by line "B" in FIG. 3.

Referring to FIG. 5, the nozzle 232 formed on the filter housing 230 is designed to inject water into the filter hosing 230.

In detail, the nozzle 232 includes a nozzle inlet 232*a* connected to the connecting tube 250 branched off from the water inlet hose 180. Also, the nozzle 232 includes a nozzle outlet 232*b* directed toward the inside of the filter housing 230 to inject water into the filter housing 230. The nozzle outlet 232*b* is designed to have a diameter smaller than the nozzle inlet 232*a* to increase water injection pressure and spread the injecting water toward the filter 211.

Therefore, the water injected from the nozzle 232 clearly removes build-up of lint from the filter 211.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A washing machine combined with a dryer, comprising:
- a tub provided with an air-vent hose at an outer surface;
- a water inlet hose to supply water to the tub;
- a filter housing including an air inlet connected to the air-vent hose, an air outlet to discharge air introduced from the air inlet, and a nozzle to inject water into the filter housing;
- a filter cover to cover a top of the filter housing; and
- a filter unit inserted into the filter housing through the filter cover,
- wherein the filter housing includes a hooking protrusion protruding from an upper periphery and the filter cover includes a coupling tab extending from a bottom thereof with a predetermined length, the coupling tab defining a coupling hole to receive the hooking protrusion.

2. The washing machine according to claim 1, wherein the filter unit includes:
- a mesh type filter;
- a filter frame formed around the filter to hold the filter; and
- a handgrip extended from a top of the filter frame.

3. The washing machine according to claim 2, wherein the handgrip includes:
- a seal groove around a lower periphery with a predetermined depth; and
- a seal filled around the seal groove.

4. The washing machine according to claim 2, wherein the handgrip includes at least one coupling rib protruding from an outer surface and the filter cover includes at least one coupling hook extending upward from a top thereof to couple with the coupling rib.

5. The washing machine according to claim 1, wherein the filter cover includes:
- a filter inserting slot defined in a top with a predetermined size to receive the filter unit; and
- a filter supporting rib extended upwardly along a periphery of the filter inserting slot with a predetermined height to support the filter unit.

6. The washing machine according to claim 1, further comprising a connecting tube branched off from the water inlet hose for connection with the nozzle.

7. The washing machine according to claim 6, wherein the connecting tube includes an on/off valve therein to selectively open and close water flow of the water inlet hose.

8. The washing machine according to claim 1, wherein the nozzle is located toward a rear of the filter unit.

9. The washing machine according to claim 1, wherein the inside diameter of the nozzle narrows toward the filter housing.

10. The washing machine according to claim 1, wherein the filter unit is installed such that it is titled toward a front of the washing machine at a predetermined angle.

11. The washing machine according to claim 1, wherein the filter cover includes:
- a filter inserting slot defined in the top thereof with a predetermined size to receive the filter unit; and
- a filter supporting rib extending upward along a periphery of the filter inserting slot with a predetermined height to support the filter unit.

12. A washing machine combined with a dryer, comprising:
- a tub provided with an air-vent hose at an outer surface;
- a water inlet hose to supply water to the tub;
- a filter housing formed with an air inlet connected to the air-vent hose and an air outlet to discharge air introduced from the air inlet;
- a filter cover to cover a top of the filter housing; and
- a filter unit inserted into the filter housing through the filter cover,
- wherein the filter housing includes:
- a nozzle to inject water into the filter housing;
- a guide rib at an inner side face with a predetermined length to guide the insertion of the filter unit; and
- a supporting protrusion formed at an inner bottom to support a lower end of the filter unit.

13. The washing machine according to claim 12, wherein the filter unit includes:
- a mesh type filter;
- a filter frame formed around the filter to hold the filter; and
- a handgrip extended from a top of the filter frame.

14. The washing machine according to claim 13, wherein the handgrip includes:
- a seal groove around a lower periphery with a predetermined depth; and
- a seal fitted around the seal groove.

15. The washing machine according to claim 13, wherein the handgrip includes at least one coupling rib protruded from an outer surface and the filter cover includes at least one coupling hook extended upwardly from a top thereof to couple with the coupling rib.

* * * * *